US005967058A

United States Patent [19]

Ambrose et al.

[11] Patent Number: 5,967,058

[45] Date of Patent: Oct. 19, 1999

[54] ARTICULATABLE FURNITURE

[75] Inventors: Frederic C. Ambrose, Brewster; David Hawley, Sterling, both of Mass.

[73] Assignee: Flex-Rest, LLC, Brewster, Mass.

[21] Appl. No.: 08/866,672

[22] Filed: Jun. 2, 1997

[51] Int. Cl.[6] ..... A47B 57/00

[52] U.S. Cl. ..... 108/64; 108/66

[58] Field of Search ..... 108/64, 66, 69, 108/65

[56] References Cited

U.S. PATENT DOCUMENTS

| | | | |
|---|---|---|---|
| D. 373,915 | 9/1996 | Lobl et al. . | |
| 2,694,611 | 11/1954 | Lorber . | |
| 2,705,179 | 3/1955 | Hodgin | 108/64 X |
| 2,792,226 | 5/1957 | Champion | 108/64 X |
| 3,002,787 | 10/1961 | Ziegenfuss | 108/64 X |
| 3,257,154 | 6/1966 | Lewis . | |
| 3,267,881 | 8/1966 | Saggione | 108/64 X |
| 3,714,906 | 2/1973 | Finestone | 108/64 |
| 3,741,852 | 6/1973 | Keener . | |
| 3,955,850 | 5/1976 | Toso . | |
| 4,732,088 | 3/1988 | Koechlin et al. . | |
| 5,016,405 | 5/1991 | Lee . | |
| 5,277,130 | 1/1994 | Caporrella | 108/64 X |
| 5,438,937 | 8/1995 | Ball et al. . | |
| 5,483,900 | 1/1996 | Elzenbeck . | |
| 5,485,795 | 1/1996 | Williams | 108/69 |
| 5,676,068 | 10/1997 | Kallander | 108/64 |

FOREIGN PATENT DOCUMENTS

| | | | |
|---|---|---|---|
| 1463176 | 12/1966 | France | 108/64 |
| 2704123 | 10/1994 | France | 108/66 |
| 2333331 | 1/1975 | Germany | 108/64 |

OTHER PUBLICATIONS

Warehouse Outlet Advertisement for Office Systems by Systema; "The Boston Globe Newspaper"; p. F5 (Aug. 6, 1998).

*Today's Facility Manager,* cover sheet and back sheet, (Jun. 1997).

*Spets Associates, Inc. Catalog,* cover sheet, pp. 29, 59, and back cover (1997).

*Primary Examiner*—Jose V. Chen

*Attorney, Agent, or Firm*—Testa, Hurwitz & Thibeault, LLP

[57] ABSTRACT

A structure system includes a plurality of elements which mate along respective cooperating concave and convex ends. Each end has a constant common radius of curvature value and spans a predetermined included angle to provide infinitely variable articulation of mating elements within respective angular ranges. The system elements may be combined to form linear combinations as well as open and closed curves. The system is suitable for use as a work surface in classroom or office environments where the arrangement of elements may be varied readily to accommodate any number of users and floor plans.

24 Claims, 6 Drawing Sheets

ARTICULATABLE FURNITURE

TECHNICAL FIELD

The present invention relates to furniture and, more specifically, to a plurality of discrete furniture elements which can be combined in various combinations and orientations to generate a variety of work surfaces or other surfaces.

BACKGROUND

Conventional furniture designed for use in educational or business settings has become increasingly modular in nature in which a limited number of discrete furniture elements may be combined in various combinations to generate a variety of configurations. Accordingly, the expense and delay associated with procuring custom furniture for a particular application can be reduced substantially. Further, as the needs of an educational provider or employer change, the furniture elements may be reconfigured and additional elements procured as necessary. For example, a plurality of rectangular furniture elements can be used on one occasion to provide parallel rows of table surfaces for student seating during lectures. On another occasion, the rectangular elements may be arranged to provide a large square or rectangular work surface for a group meeting or discussion.

A desirable feature of such furniture elements is that a substantially contiguous work surface can be produced without gaps or other substantial discontinuities. Accordingly, a fundamental characteristic of such furniture is that each of the furniture elements shares a common feature, such as a lineal dimension of a mating surface. For example, a rectangular element may have a short side dimension of one unit and a long side dimension of two units. By mating the short sides of two such elements together, a large contiguous rectangular work surface may be generated having a short side dimension of one unit and a long side dimension of four units. Alternatively, by mating the long sides of two such elements together, a large contiguous square work surface may be generated having a common side dimension of two units. Other common polygonal furniture elements, such as those which are trapezoidal, pentagonal, hexagonal, or octagonal in shape, may be used in combination with other polygonal furniture elements to create extended work surfaces comprising a series of clustered work surfaces connected by linking work surfaces. Exemplary embodiments of such configurations are depicted in U.S. Pat. No. 5,016,405 issued to Lee, the disclosure of which is herein incorporated by reference in its entirety.

Another type of modular furniture element may employ mating surfaces which are contoured or arcuate instead of linear, such as those depicted in U.S. Pat. No. 3,714,906 issued to Finestone, U.S. Pat. No. 3,955,850 issued to Toso, and U.S. Pat. No. Des. 373,915 issued to Lobl et al., the disclosures of which are herein incorporated by reference in their entirety. According to these designs, an outwardly extending contour of one furniture element mates with a recessed contour of another furniture element. Applications include work surfaces, such as tables, and seating, such as armchairs and divans. U.S. Pat. No. 5,438,937 issued to Ball et al., the disclosure of which is herein incorporated by reference in its entirety, incorporates furniture elements in a system which utilizes both lineal and arcuate mating surfaces.

While such furniture may function as intended, the relative orientation of one element to the next is substantially fixed due to the restrictive nature of the mating surfaces. For example, as discussed hereinabove with respect to the example of the two rectangular elements, solely two configurations are possible, namely a long rectangular table or a large square table. No other combination is possible in which the mating surfaces abut to generate a substantially contiguous surface. In other words, solely a finite number of furniture configurations are possible, based upon the discrete number of different furniture elements and the number and type of mating surfaces. For furniture which incorporates a uniform circular element, while a mating arcuate element may be oriented relative thereto at substantially any angular orientation, such reorientation does not change the external configuration of the combination. For example, solely one combination can be made of a circular table element and a rectangular table element with a matching arcuate recess, regardless of the relative angular orientation of the circular element relative to the rectangular element.

SUMMARY OF THE INVENTION

According to the invention, articulatable furniture includes at least a first element. The first element includes a convex arcuate end having a constant radius of curvature spanning a predetermined included angle and located at a predetermined angular orientation relative to the remainder of the element. The first element may also include a concave arcuate end disposed remotely from the convex arcuate end. The concave arcuate end has a constant radius of curvature slightly greater than or substantially equal to the radius of curvature of the convex end. The concave end has a predetermined included angle less than that of the convex end and which is located at a predetermined angular orientation.

Accordingly, two such first elements may be arranged in mating relation with the convex arcuate end of one of the first elements mating with the concave arcuate end of the other first element. The two elements form a substantially contiguous, uninterrupted surface; however, since the included angle of the convex end is greater than that of the mating concave end, the two elements may be rotated or pivoted relative to each other about an origin of the radius of curvature within a range defined by the difference of the included angle values. As a result, the relative orientation of the two elements is infinitely variable within the range which may be as small as thirty degrees or less to as large as 270 degrees or more. The operation of the mating elements may be considered similar in principle to the operation of a ball and socket joint when articulated solely within a given plane. More than two first elements may be mated serially as desired to form a variety of contiguous surfaces including linear rows, polygons, open curves, and closed curves.

To facilitate articulation, a pivot member may be employed, linking the two elements together while permitting pivotal motion therebetween. The pivot member may be configured as a beam, plate, V-shaped structure, or any other design which is fixedly attached to the concave arcuate end and which pivots about the origin of the radius of curvature of the convex arcuate end of the mating element. The pivot member may be supported along an arcuate track of the convex end to provide additional stability. The pivot member may also include a chase for routing cabling between the two elements.

In an exemplary embodiment, the elements are tables which include one or more legs with or without wheels. Alternatively, instead of employing two first elements, a first element may be mated with a second element suitably configured with either a mating convex arcuate end or a mating concave arcuate end. The first element may be a table with one or more legs and the second element a table leaf Depending on the relative sizes of the table and leaf and the proposed use, the leaf may be supported solely by a pivot member linking the two elements together or may also include one or more legs.

Other useful elements include those which have two remotely disposed concave arcuate ends, those which have two remotely disposed convex arcuate ends, and those with solely either a concave or convex arcuate end. The other end may be contoured or linear as desired. The individual elements may be used in any mating combination as free standing tables or as table leaves, with or without legs, as desired.

In an exemplary embodiment, the articulatable furniture may be used in an educational setting for teaching computer skills. Discrete elements may each support a video monitor or display and one or more data input devices such as a keyboard and a computer mouse. A plurality of similar or dissimilar elements may be arranged rapidly and easily to accommodate any number of trainees in a variety of configurations to accommodate different floor plans. Electrical power and communications cabling may be routed advantageously from one element to the next by providing male plugs or connectors disposed at a convex end of each element and mating female sockets or connectors at the other end thereof to facilitate connections between mating elements. Latches may also be provided to lock the elements together once arranged to prevent relative rotation. Additionally partitions may be provided to create workstations of one or more contiguous elements.

BRIEF DESCRIPTION OF THE DRAWINGS

The invention, in accordance with preferred and exemplary embodiments, together with further advantages thereof, is more particularly described in the following detailed description taken in conjunction with the accompanying drawings in which.

DESCRIPTION

Figures 1A, 1B, 1C, 1D, 1E, 1F:
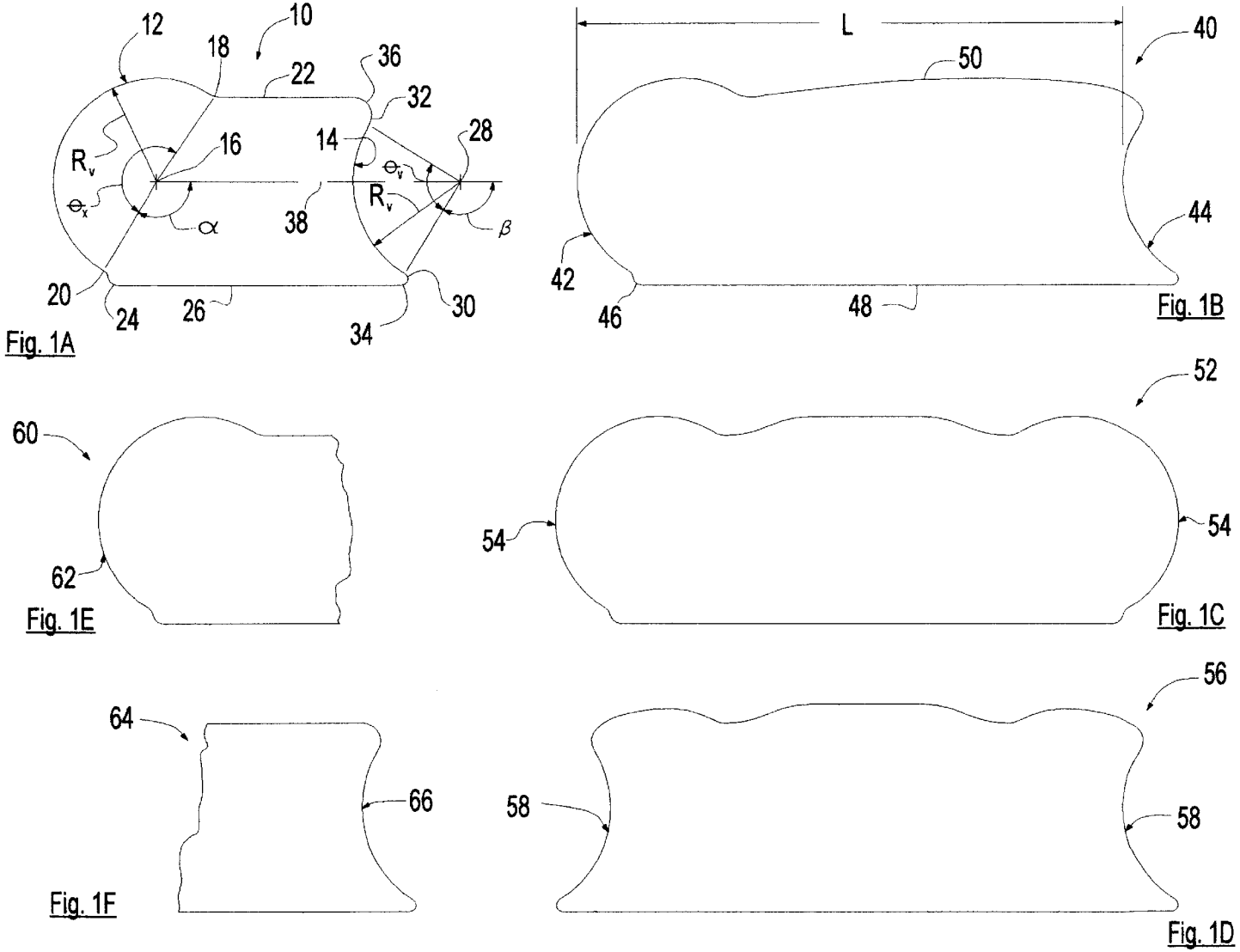
FIG. 1A is schematic plan view of a basic length furniture element with both convex and concave ends in accordance with an exemplary embodiment of the present invention.
FIG. 1B is a schematic plan view of an extended length furniture element with both convex and concave ends in accordance with an exemplary embodiment of the present invention.
FIG. 1C is a schematic plan view of an extended length furniture element with two convex ends in accordance with an exemplary embodiment of the present invention.
FIG. 1D is a schematic plan view of an extended length furniture element with two concave ends in accordance with an exemplary embodiment of the present invention.
FIG. 1E is a schematic plan view of an end element with one convex end in accordance with an exemplary embodiment of the present invention.
FIG. 1F is a schematic plan view of an end element with one concave end in accordance with an exemplary embodiment of the present invention.

Referring now to FIG. 1A, a basic furniture element 10 may be sized to accommodate a single user and includes both a convex end 12 and a concave end 14. The convex end 12 is generally arcuate, having a substantially constant radius of curvature value, $R_X$, extending from an origin 16 disposed within the boundary of the element 10. The circumferential extent or sweep of the convex arcuate end 12 may be defined by an included angle value, $\theta_X$, which extends between respective termination points 18, 20. In this particular embodiment, $\theta_X$ is equal to about 180 degrees. At the termination points 18, 20, the convex arcuate contour terminates and a linear edge or a contoured edge begins. For the element 10, a linear edge 22 intersects the convex arcuate end 12 at termination point 18, and a contoured edge 24 intersects the convex arcuate end 12 at termination point 20. The contoured edge 24 also intersects linear edge 26. As will be discussed in greater detail hereinbelow, the termination points 18, 20 limit the range of articulation or rotation of the element 10 relative to a mating element.

The element 10 also includes a concave end 14 disposed remotely from the convex end 12. As used herein, the term "remotely" means that respective arcuate edges of the convex end 12 and the concave end 14 are not contiguous, there being at least one intermediate edge disposed therebetween, such as a linear edge 22. The concave end 14 is generally arcuate, having a substantially constant radius of curvature value, $R_V$, extending from an origin 28 disposed outside the boundary of the element 10. The circumferential extent or sweep of the concave arcuate end 14 may be defined by an included angle value, $\theta_V$, which extends between respective termination points 30, 32. In this particular embodiment, $\theta_V$ is equal to about 100 degrees. At the termination points 30, 32, the concave arcuate contour terminates and a linear edge or a contoured edge begins. For the element 10, a contoured edge 34 connects the concave arcuate contour at the termination point 30 to the linear edge 26 and a contoured edge 36 connects the concave arcuate contour at the termination point 32 to the linear edge 22.

In an exemplary embodiment, the concave end radius of curvature value, $R_V$, is slightly greater than or substantially equal to the convex end radius of curvature value, $R_X$. Additionally, the concave end included angle value, $\theta_V$, of about 180 degrees is greater than the convex end included angle value, $\theta_X$, of about 100 degrees. Accordingly, a second basic element 10 would mate properly with the first basic element 10 and the angular range of articulation between the two elements 10 would be about 80 degrees, the difference between $\theta_V$ and $\theta_X$.

As may be readily appreciated, the location of the origins 16, 28, and the angular orientation of the included angles $\theta_X$, $\theta_V$ determines the range of configurations of mated elements. For example, for the basic element 10, an orientation line 38 may be drawn passing through both origins 16, 28. The orientation line 38 need not be collinear with a centerline or an axis of symmetry of the element 10, if any such centerline or axis of symmetry exists. The orientation of the convex included angle, $\theta_X$, relative to the orientation line 38 is angle $\alpha$ and the orientation of the concave included angle, $\theta_V$, relative to the orientation line 38 is angle $\beta$. In the case where the values of angle $\alpha$ and angle $\beta$ a substantially equivalent, as depicted in FIG. 1A, mating of two of the elements 10 produces a combination in which the respective orientation lines 38 are collinear when the elements 10 are at one of the limits of the articulatable range. Further, where the orientation line 38 is also parallel to and equidistant from a linear edge such as linear edge 26, the resultant combination will have collinear linear edges 26 so that a series of mated elements 10 could be used to generate a long, straight table or other surface. By articulating the elements 10 relative to each other and adding a plurality of additional elements 10, combinations can be generated resembling polygons, open curves, and closed curves.

Naturally, combinations of furniture elements need not include a plurality of solely the element 10. For example, the length, L, of the element 10 may be increased to accommodate seating for two or more users as shown with respect to extended furniture element 40 in FIG. 1B. The length, L, extends generally from an outermost edge of a convex end 42 to an innermost edge of a concave end 44, The extended element 40 also includes a contoured edge 46 contiguous with a linear edge 48, similar to edges 24, 26 of basic element 10, and a second contoured edge 50. Instead of being limited to furniture elements having both a convex end and a concave end, FIG. 1C depicts a second extended element 52 which includes two convex ends 54. A third extended element 56 depicted in FIG. 1D includes two concave ends 58.

As may be appreciated, it may be desirable in certain applications to terminate a combination of elements in a manner other than with a concave end or a convex end. Accordingly, an end element 60 can be provided with solely a convex end 62 as depicted in FIG. 1E to mate with an exposed concave end. The remainder of the convex end element 60 may be of any shape desired, as signified by an irregular line. Similarly, a second end element 64 depicted in FIG. 1F can be provided with solely a concave end 66 to mate with an exposed convex end. The remainder of the concave end element 66 may be of any shape desired. Relative widths, lengths, radii, included angles, and orientation angles for the furniture elements depicted in FIGS. 1A–1F may be predetermined to facilitate free interchangeability of elements or alternatively to provide for only certain combinations of elements.

Figure 2A:
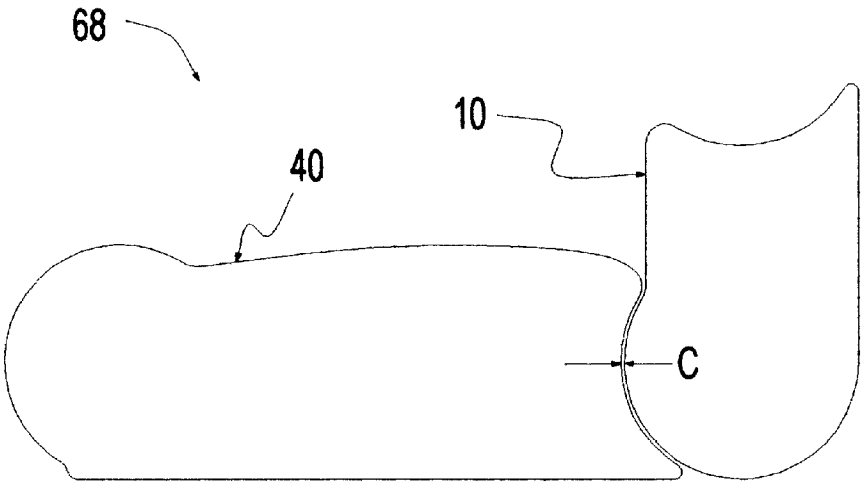
FIG. 2A is a schematic plan view of a combination of two mating elements in accordance with an exemplary embodiment of the present invention.
Figure 2B:
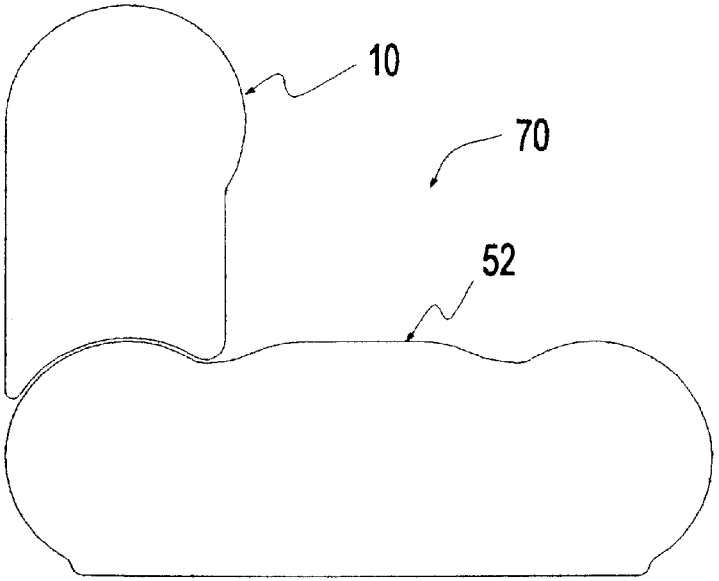
FIG. 2B is a schematic plan view of another combination of two mating elements in accordance with an embodiment of the present invention.

Referring now to FIG. 2A, a combination 68 is depicted which includes solely the basic element 10 and the extended element 40 oriented to form a right angle corner. The respective origins of radii of mating convex and concave ends are substantially coincident. A slight clearance, C, can be provided by manufacturing the concave end of the extended element 40 with a slightly greater radius of curvature value than that of the convex end of basic element 10. The magnitude of the clearance is the difference between the two radii. Another combination 70 is depicted in FIG. 2B which includes the basic element 10 mating with the extended element 52 having two convex ends. Here again, a slight clearance has been provided between the concave end of basic element 10 and one of the convex ends of the extended element 52, the elements 10, 52 being oriented to form a right angle corner.

Figure 2C:
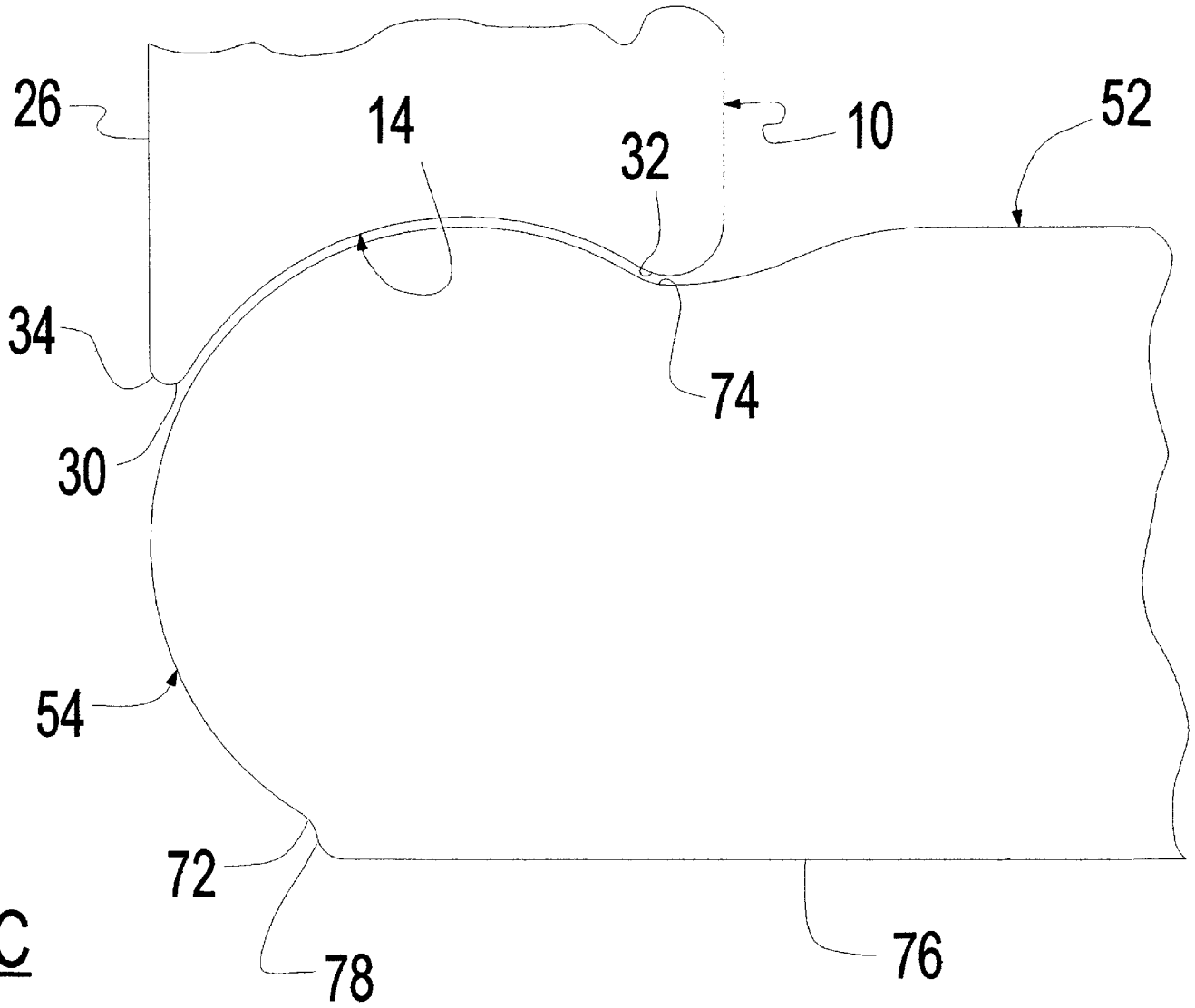
FIG. 2C is an enlarged schematic plan view of the mating ends of the elements depicted in FIG. 2B in accordance with an embodiment of the present invention.

As mentioned hereinabove, respective termination points of the mating arcuate ends define the range of articulation of the mating elements. An enlarged view of the mating ends of combination 70 is shown in FIG. 2C to illustrate this feature. Convex end 54 of element 52 extends between termination points 72, 74 and concave end 14 of element 10 extends between termination points 30, 32. Accordingly, when concave end termination point 32 is substantially coincident with convex end termination point 74 as depicted, the combination 70 is at one limit of the range of articulation. In this case, the linear edge 26 of the basic element 10 forms a right angle corner with a linear edge 76 of the extended element 52 at this range limit, with the exposed portion of the convex end 54 and the contoured edge 34 providing a smooth, substantially uniform transition therebetween. At the other range limit, concave end termination point 30 is substantially coincident with convex end termination point 72, forming a substantially straight edge with linear edge 26 collinear with linear edge 76. A transition contoured edge 78 may be provided interdisposed between convex end 54 and linear edge 76, as depicted, to form a positive stop, abutting contoured edge 34 at the range limit. Alternatively, no such transition edge 78 need be provided. Any attempt to continue articulation of the mating elements 10, 52 beyond the range limits results in separation of the concave end 14 from the convex end 54.

Figure 3:
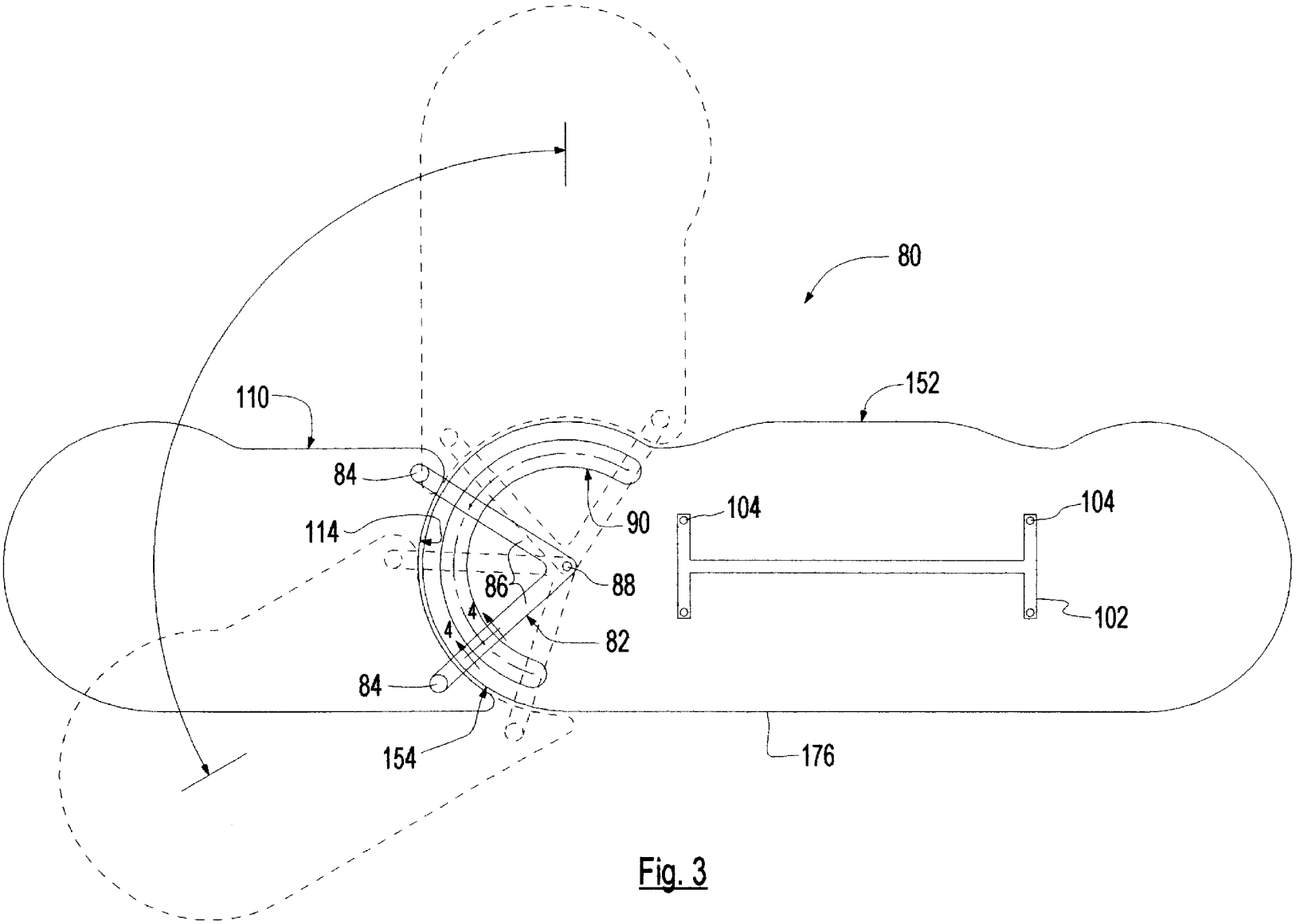
FIG. 3 is a schematic plan view of the combination depicted in FIG. 2B showing an exemplary angular range of articulation and an exemplary pivot member in accordance with an alternative embodiment of the present invention.

To facilitate articulation and also prevent articulation beyond the range limits with resultant separation of the mating ends, a combination 80 may include a pivot member 82 attached to an underside thereof to link the elements together while permitting relative pivotal motion as shown in FIG. 3. The combination 80 includes a basic element 110 and an extended element 152. The combination 80 is substantially similar to the combination 70; however, the range of articulation is greater. Further, the element 152 does not include the transition contoured edge 78, but rather smoothly transitions between a convex end 154 and a linear edge 176.

The pivot member 82 is configured as a V-shaped structure in plan view. The pivot member 82 is fixedly attached to an underside of the concave end 114 of the basic element 110 at outermost points 84 of respective legs 86, for example by nut and bolt assemblies. The pivot member 82 is also attached to an underside of the convex end 154 of the extended element 152 at a pivot point 88 about which the pivot member 82 can pivot. The pivot point 88 is substantially coincident with an origin of the radius of curvature of the convex end 154. Accordingly, the mating elements 110, 152 cannot be pulled apart and can be freely rotated between range limits. As can be seen in broken line in FIG. 3, the range of articulation for the combination 80 is about 120 degrees, from a positive ninety degree right angle corner configuration to a negative thirty degree configuration, the angles being measure relative to the linear configuration depicted in solid line.

Figure 4:
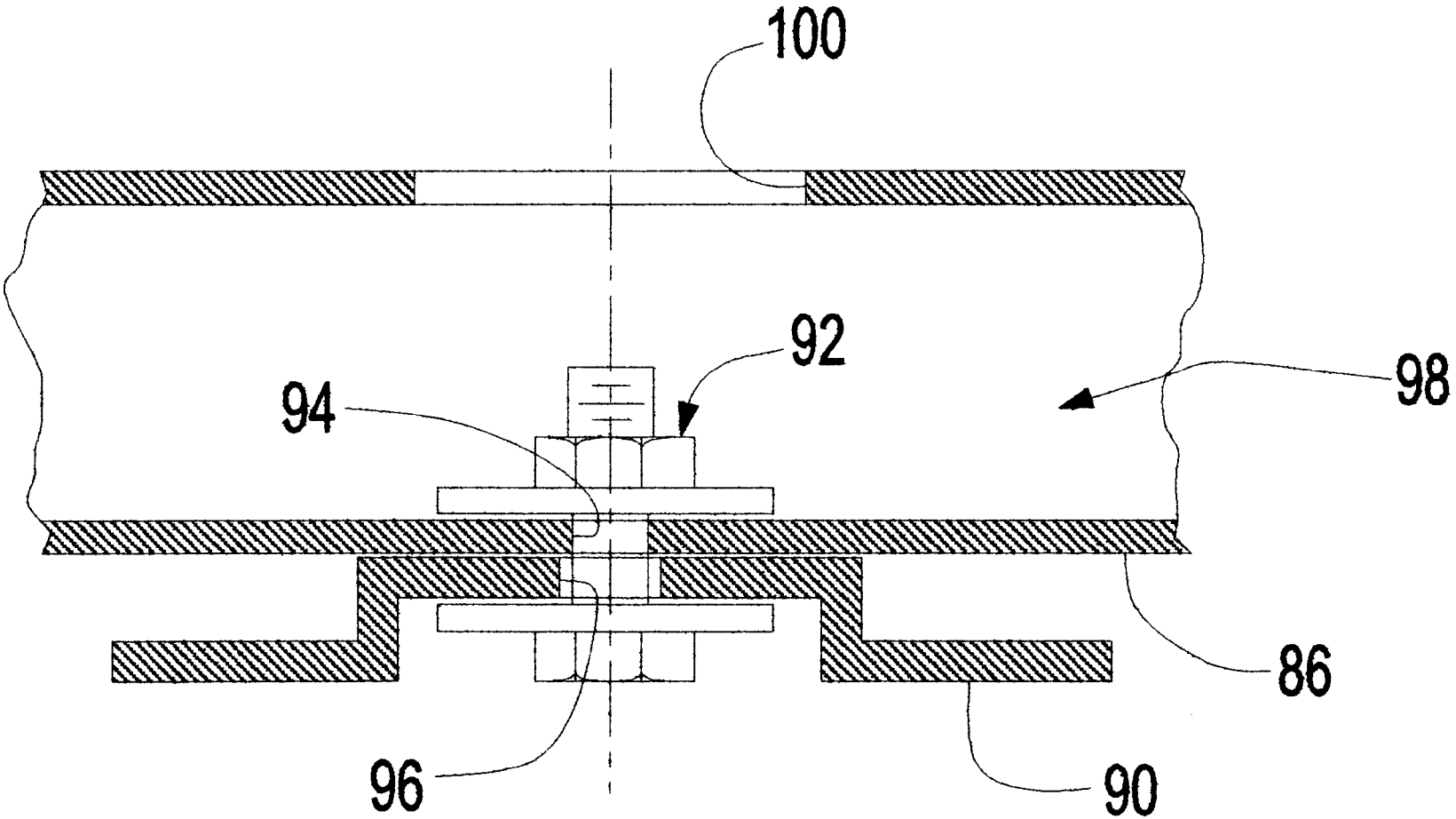
FIG. 4 is a schematic sectional view of the pivot member and arcuate track taken along line 4—4 of FIG. 3 in accordance with an alternative exemplary embodiment of the present invention.

To provide additional stability, an arcuate track 90 may be fixedly mounted to the convex end 154. Referring to FIG. 4, which is a schematic sectional view of one pivot member leg 86 and the arcuate track 90 taken along line 4—4 of FIG. 3, a nut and bolt assembly 92 or equivalent structure passes through a close fitting bore 94 of the leg 86 and an oversize arcuate cutout 96 of the track 90. The track 90 may be shaped as shown with a raised central portion to permit surface mounting of the track 90 on the underside of the convex end 154. Alternatively, a suitable groove could be formed in the convex end 154 to provide clearance for the captured end of the nut and bolt assembly 92. A conventional anti-rotation feature such as an enlarged rectangular bolt head may be provided to facilitate rapid assembly and disassembly of the nut and bolt assembly 92 without the need to remove the track 90 from the convex end 154. Suitable lubrication or a low friction washer could be provided between sliding surfaces of the leg 86 and track 90 to further facilitate articulation. If desired, one or more open or closed chases 98 could be provided along the legs 86 for routing electrical power and communications cabling between the elements 10, 152. An access port 100 is provided in the leg 86 along the chase 98 so that the nut and bolt assembly 92 can be reached with conventional tooling.

Referring once again to FIG. 3, the extended element 152 may include one or more legs 102. The legs 102 may be of any configuration, such as spindles or planar elements, and may include wheels, adjustable pads, or other features 104 to facilitate movement of the element 152 and accommodate irregular floor surfaces. Basic element 110 may also include one or more legs 102. In an application in which the extended element 152 is being used as a table and the basic element 110 is being used solely as an articulatable extension or leaf thereof, the basic element 110 could be supported by the pivot member 82 and arcuate track 90 without additional legs 102. Wherever employed, the legs 102 may be removable or may fold against the underside of the element to facilitate transport and storage.

Figure 5D:
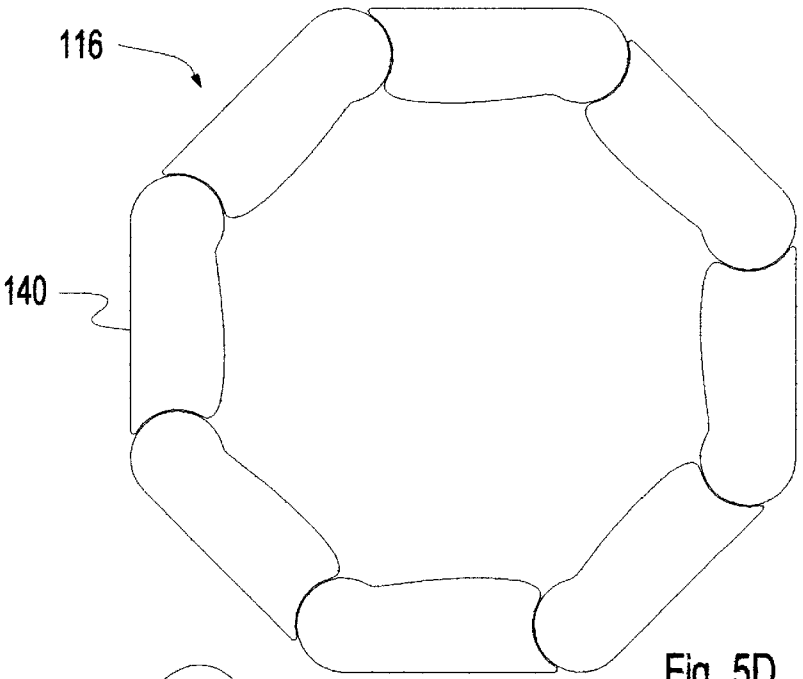
FIG. 5D is a schematic plan view of a combination of eight mating elements in accordance with an alternative embodiment of the present invention.
Figure 5B:
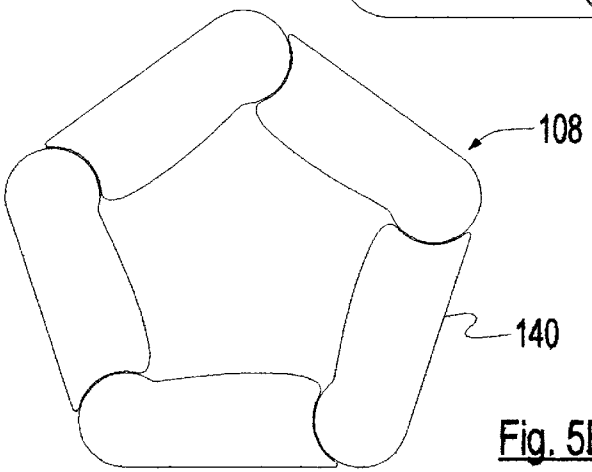
FIG. 5B is a schematic plan view of a combination of five mating elements in accordance with an alternative embodiment of the present invention.
Figure 5C:
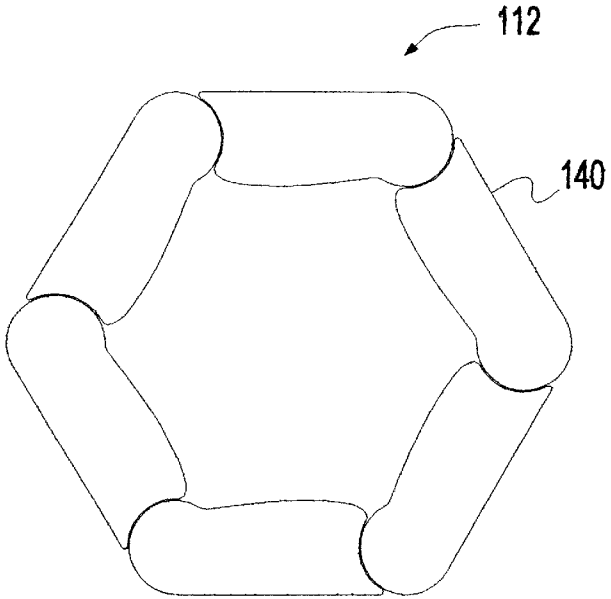
FIG. 5C is a schematic plan view of a combination of six mating elements in accordance with an alternative embodiment of the present invention.
Figure 5A:
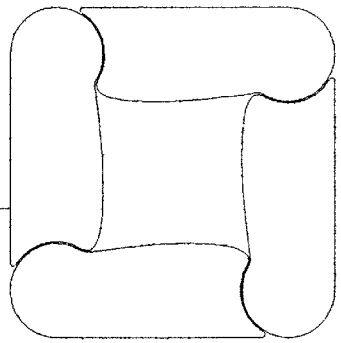
FIG. 5A is a schematic plan view of a combination of four mating elements in accordance with an alternative embodiment of the present invention.

Examples of closed polygonal combinations of extended elements 140 are depicted in FIGS. 5A–5D. Such combinations may be useful to accommodate meetings of various sizes in which face-to-face discussions are desired. FIG. 5A employs four of the elements 140 in a quadrilateral or square combination 106. FIG. 5B employs five of the elements 140 in a pentagonal combination 108. FIG. 5C employs six of the elements 140 in an hexagonal combination 112. Lastly, FIG. 5D employs eight of the elements 140 in an octagonal combination 116. While the combinations of FIGS. 5A–5D are shown as regular polygons, the angles formed between mating elements 140 may be varied within the allowable articulation range to produce different shapes. Additionally, one or more elements 140 could be eliminated to produce open curves to accommodate a centrally disposed moderator or speaker.

Each element may also be provided with a wiring harness having, for example, ten communications cables and an electrical power cable. When configured with suitable connectors and/or junction boxes, up to ten computers located at mating elements could be wired in parallel. An element designated as an instructor workstation would have access to each of the ten communications cables to monitor activity at each computer, as desired.

The elements may be manufactured in various sizes, configurations, and materials. By way of example, the basic element 10 may have a length, L, of about 46 inches, a width of about 29 inches, a convex radius of curvature value $R_X$ of about 16.0 inches, and a concave radius of curvature value $R_V$ of about 16.5 inches. Mating two such basic elements 10 together would yield a end clearance C of about 0.5 inches. The element 10 may be manufactured from wood, metal, polymer, or any other suitable natural or synthetic material. The surface of the element 10 may also include a cutout or relief for mounting equipment such as a computer monitor in a recessed or partially recessed manner.

While there have been described herein what are to be considered exemplary and preferred embodiments of the present invention, other modifications of the invention will become apparent to those skilled in the art from the teachings herein. For example, the articulatable furniture generated by various combination of individual elements may be used for purposes other than as tables or work surfaces. In an alternative embodiment, the articulatable furniture may be used as seating or bedding with suitable padding or cushioning disposed on a surface thereof In another alternative embodiment, the articulatable furniture may be used as a raised platform or walkway with an associated edge railing or guard, if desired. Still further, the articulatable furniture could be used as a barricade or railing to control the movement of persons or animals. Additional features may be provided such as stake rings or mounting plates to anchor temporarily the furniture to the ground or floor surface.

The particular methods of manufacture of discrete components, geometries, and interconnections therebetween disclosed herein are exemplary in nature and not to be considered limiting. It is therefore desired to be secured in the appended claims all such modifications as fall within the spirit and scope of the invention. Accordingly, what is desired to be secured by Letters Patent is the invention as defined and differentiated in the following claims.

What is claimed is:

1. A structure comprising:

a first element comprising:

a first convex arcuate end comprising:

a constant radius of curvature having a first origin and a value, $R_{X1}$;

an included angle value, $\theta_{X1}$; and an orientation angle, $\alpha$ having a value greater than 90 degrees, and a first concave arcuate end disposed remotely therefrom comprising:

a constant radius of curvature having a second origin and a value, $R_{V1}$; and an included angle value, $\theta_{V1}$, wherein $\theta_{X1}$ is greater than $\theta_{V1}$; and the first origin and the second origin define an orientation line passing therethrough from which the orientation angle , is measured.

2. The invention according to claim 1 wherein $R_{V1}$ is greater than or substantially equal to $R_{X1}$.

3. The invention according to claim 1 wherein the difference between $\theta_{X1}$ and $\theta_{V1}$ is less than about 270 degrees.

4. The invention according to claim 1 further comprising:

a second element comprising:

a second convex arcuate end comprising:

a constant radius of curvature value, $R_{X2}$; and an included angle value, $\theta_{X2}$; and a second concave arcuate end disposed remotely therefrom comprising:

a constant radius of curvature value, $R_{V2}$; and an included angle value, $\theta_{V2}$, wherein at least one of:

the second convex arcuate end mates with the first concave arcuate end; and the second concave arcuate end mates with the first convex arcuate end.

5. The invention according to claim 4 wherein $\theta_{X2}$ is greater than $\theta_{V1}$.

6. The invention according to claim 4 wherein $\theta_{X1}$ is greater than $\theta_{V2}$.

7. The invention according to claim 4 wherein the first element is pivotable relative to the second element generally about an origin of $R_{X2}$.

8. The invention according to claim 7 further comprising a pivot member linking the first element to the second element generally along a line which passes through the origin of $R_{X2}$.

9. The invention according to claim 8 wherein the pivot member forms a chase for routing a cable.

10. The invention according to claim 4 wherein the second element is pivotable relative to the first element generally about the origin of $R_{X1}$.

11. The invention according to claim 10 further comprising a pivot member linking the first element to the second element generally along a line which passes through the origin of $R_{X1}$.

12. The invention according to claim 11 wherein the pivot member forms a chase for routing a cable.

13. The invention according to claim 4 further comprising a leg attached to at least one of the first element and the second element.

14. The invention according to claim 1 further comprising a leg attached to the first element.

15. A structure comprising:

a first element comprising:

a first convex arcuate end comprising:

a constant radius of curvature value, $R_{X1}$; and an included angle value, $\theta_{X1}$;

a first concave arcuate end disposed remotely therefrom comprising:

a constant radius of curvature value, $R_{V1}$; and an included angle value, $\theta_{V1}$, wherein $\theta_{X1}$ is greater than $\theta_{V1}$;

a second element comprising:

a second convex arcuate end comprising:

a constant radius of curvature value, $R_{X2}$; and an included angle value, $\theta_{X2}$; and a second concave arcuate end disposed remotely therefrom comprising:

a constant radius of curvature value, $R_{V2}$; and an included angle value, $\theta_{V2}$, wherein at least one of the second convex arcuate end mates with the first concave arcuate end and the second concave arcuate end mates with the first convex arcuate end and wherein the first element is pivotable relative to the second element generally about an origin of $R_{X2}$; and a pivot member linking the first element to the second element generally along a line which passes through the origin of $R_{X2}$, wherein the pivot member forms a chase for routing a cable.

16. A structure comprising:

a first element comprising:

a first convex arcuate end comprising:

a constant radius of curvature value, $R_{X1}$; and an included angle value, $\theta_{X1}$; and a first concave arcuate end disposed remotely therefrom comprising:

a constant radius of curvature value, $R_{V1}$; and an included angle value, $\theta$V1, wherein $\theta_{X1}$ is greater than $\theta_{V1}$;

a second element comprising:

a second convex arcuate end comprising:

a constant radius of curvature value, $R_{X2}$; and an included angle value, $\theta_{X2}$; and a second concave arcuate end disposed remotely therefrom comprising:

a constant radius of curvature value, $R_{V2}$; and an included angle value, $\theta_{V2}$, wherein at least one of the second convex arcuate end mates with the first concave arcuate end and the second concave arcuate end mates with the first convex arcuate end and wherein the second element is pivotable relative to the first element generally about an origin of $R_{X1}$; and a pivot member linking the first element to the second element generally along a line which passes through the origin of $R_{X1}$, wherein the pivot member forms a chase for routing a cable.

17. A structure system comprising:

a first element comprising:

a first convex arcuate end comprising:

a radius of curvature having an origin and a value, $R_{X1}$;

an included angle value, $\theta_{X1}$, less than 360 degrees; and an orientation angle, $\alpha$, having a value greater than 90 degrees; and an edge extending generally along a length of the first element; and a second element comprising:

a first concave arcuate end comprising:

a radius of curvature value, $R_{V2}$, substantially equal to or greater than $R_{X1}$, wherein:

the first concave arcuate end is adapted to engage the first convex arcuate end;

the second element is pivotable relative to said first element generally about the origin of $R_{X1}$; and the orientation angle , is measured from an orientation line passing through the origin of $R_{X1}$, the orientation line extending generally along the edge of the first element.

18. The invention according to claim 17 wherein the first element further comprises a second convex arcuate end disposed remotely from the first convex arcuate end.

19. The invention according to claim 17 wherein the second element further comprises a second concave arcuate end disposed remotely from the first concave arcuate end.

20. The invention according to claim 17 further comprising a pivot member connecting the first element to the second element generally along a line which passes through the origin of $R_{X1}$.

21. The invention according to claim 20 wherein the pivot member forms a chase for routing a cable.

22. The invention according to claim 17 further comprising a leg attached to at least one of the first element and the second element.

23. The invention according to claim 17 further comprising:

a first leg attached to the first element; and a second leg attached to the second element.

24. A structure system comprising:

a first element comprising:

a first convex arcuate end comprising:

a radius of curvature value, $R_{X1}$; and an included angle value, $\theta_{X1}$, less than 360 degrees;

a second element comprising:

a first concave arcuate end comprising:

a radius of curvature value, $R_{V2}$ substantially equal to or greater than $R_{X1}$, wherein the first concave arcuate end is adapted to engage the first convex arcuate end and the second element is pivotable relative to said first element generally about an origin of $R_{X1}$; and a pivot member connecting the first element to the second element generally along a line which passes through the origin of $R_{X1}$, wherein the pivot member forms a chase for routing a cable.

* * * * *